United States Patent [19]

Iida

[11] Patent Number: 5,022,931

[45] Date of Patent: Jun. 11, 1991

[54] PROCESS FOR HOT WORKING ARTICLE DEFINING HOLE AT THE CENTER THEREOF

[75] Inventor: Hiroshi Iida, Kiyose, Japan

[73] Assignees: Sumitomo Heavy Industries, Tokyo; Sumitomo Precision Products, Co., Amagasaki, both of Japan

[21] Appl. No.: 503,592

[22] Filed: Apr. 3, 1990

[30] Foreign Application Priority Data

Nov. 10, 1989 [JP] Japan ..... 1-291288

[51] Int. Cl.[5] ..... C21D 7/13

[52] U.S. Cl. ..... 148/12 R; 148/11.5 R; 148/16; 148/16.7; 148/130; 148/157

[58] Field of Search ..... 148/12.1, 16, 16.7, 148/157, 130, 11.5 R, 12 R, 12 F; 72/365

[56] References Cited

U.S. PATENT DOCUMENTS 2,458,715 1/1949 Marencik et al. ..... 148/11.5 R 2,799,604 7/1957 Ness ..... 148/16

*Primary Examiner*—R. Dean

*Assistant Examiner*—Robert R. Koehler

*Attorney, Agent, or Firm*—Armstrong, Nikaido, Marmelstein, Kubovcik & Murray

[57] ABSTRACT

A process for hot working a tubular material having one open end and the other closed end including the steps of: injecting an inert gas into the hole of the material; then fastening a cap to the open end of the material in order to hermetically seal the hole; then heating the material and concurrently subjecting same to forging or the like. Then, the end to which cap has been fastened is separated from the remainder of the material, so that a final product results. The process has an advantage in that it easily, inexpensively prevents a layer transmuted due to heating from occurring in the surface of the hole.

3 Claims, 2 Drawing Sheets

PROCESS FOR HOT WORKING ARTICLE DEFINING HOLE AT THE CENTER THEREOF

BACKGROUND OF THE INVENTION

1. Field of the Invention

The present invention relates to a process for preventing an occurrence of a transmuted layer (e.g., an oxidized layer or decarburized layer) in the surface of a hole defined in an forged article or the like which hole is difficult to eliminate the transmuted layer produced when a steel of the forged article is heated. It relates more particularly to a process which prevents or reduces an occurrence of an oxidized layer or decarburized layer by filling the hole with an inert gas, e.g., argon gas.

2. Description of the Prior Art

Hitherto, a hammer or press has performed an forging. A heating temperature of forging is 1,000°-1,200° C., a higher heating temperature more facilitating the forging. A normalizing temperature is about 900° C. An annealing temperature is 650°-850° C. In addition, in order to prevent the occurrence of the transmuted layer in the surface of a hole defined in a holed forged article, copper plating or various coatings have been applied to the surface. However, copper plating can be effective only up to about 950° C. and the coatings are difficult to eliminate after heating.

Herein, decarburization is a phenomenon in which carbon contained in steel is oxidized and released as a gas to the outside of the steel when the steel is heated in the atmosphere, so that a carbon concentration in a surface layer of the steel is reduced thereby to reduce a hardness of the surface layer. The reduction in the hardness reduces a fatigue limit of the steel. Herein, an oxidized layer means a zone of the steel in which the steel itself has been oxidized to be transmuted and which can be flaked from the surface of the steel in the form of scale.

In addition, a process of heating the holed forged article with an inert gas flowed has also prevalied. However, the process requires a larger amount of the inert gas, which is very costly. The effect of the flowed inert gas has been made unstable by the mixing of air.

SUMMARY OF THE INVENTION

In view of problems in prior art, an object of the present invention is to provide a novel simple process for preventing an occurrence of a transmuted layer produced in the surface of the hole of a holed forged article by heating, the prevention process being conducted at a low cost and enduring even a high temperature.

In order to achieve the object, the present invention is to provide a process for hot working an article defining a hole at the center thereof from a tubular material which has a hole being open at one end of the material and closed at the other end of the material, the hot working process comprising the steps of: injecting an inert gas through said open end into the hole; then fastening a cap to said open end to seal the hole; heating the tubular material the hole of which has been filled with the inert gas; then hot working the tubular material; then separating said end to which the cap has been fastened from the reminder of the tubular material. If the hole is open at both ends, similar procedure can be applied to achieve the object.

The other objects, arrangements, operations and advantages of the present invention will be apparent from the attached claims and the description of the preferred embodiment with reference to the attached drawings.

DESCRIPTION OF THE PREFERRED EMBODIMENT

Figure 1A:
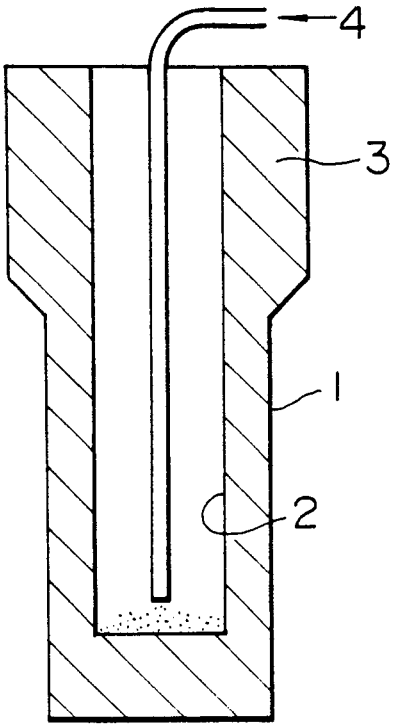
FIGS 1*a*, 1*b* and 1*c* illustrate respective states of steps of a hot working process of the present invention.

The preferred embodiment, e.g., forging of the present invention will be described with reference to FIGS. 1*a*, 1*b* and 1*c*. In FIG. 1*a*, a preforged material with a center hole 2 or tubular material is indicated at 1, the center hole 2 extending axially of the material 1, and a thick-walled portion provided around an open end of the material 1 is indicated at 3. The thick-walled portion 3 is to be forged.

As shown in FIG. 1*a*, argon gas 4 (hereinafter referred to as Ar gas) is injected into the center hole 2 prior to forging. Since a specific gravity of Ar gas is larger than that of air (i.e., about 1.4 times that of air), the Ar gas completely replaces air within the center hole 2 when a hose for Ar gas which is extended to the bottom of the center hole 2 with the open end higher positioned than a closed end of the material 1 quietly injects Ar gas into the center hole 2. An oxygen densitometer (not shown) positioned near the open end of the material 1 detects a completion of the replacement.

Figure 1B:
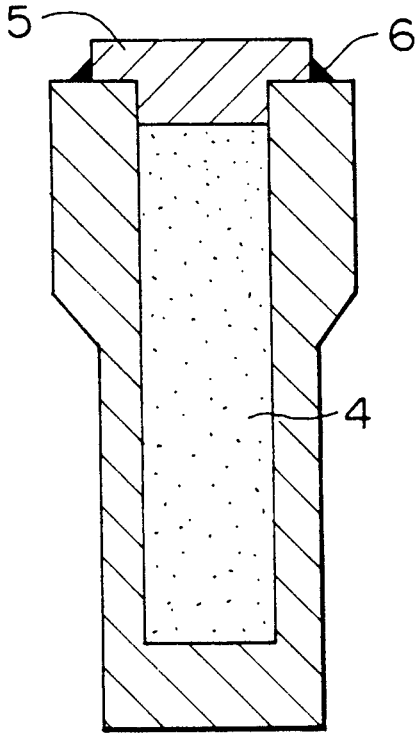

As shown in FIG. 1*b*, then a plug or cap 5 is fitted on the open end of the material 1 and a weld-all-around 6 is applied to a joint between the outer cylindrical portion of the cap 5 and an open end surface of the material 1 in order to seal the Ar gas within the center hole 2.

Figure 1C:
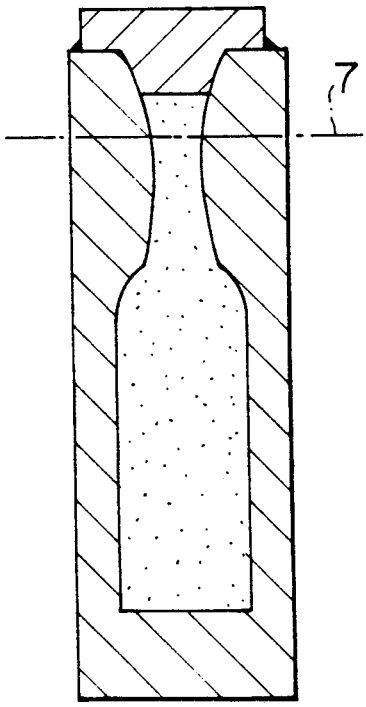

As shown in FIG. 1*c*, then forging the heated material 1 compresses same axially thereof and then the resulting material 1 is heat treated, i.e., normalized and/or annealed. Then, the upper end of the material 1 is separated from the remainder of the material 1 on a cutting plane line 7 with the cap 5 remaining hermetically fastened to the upper end (see FIG. 1*c*).

Figure 2:
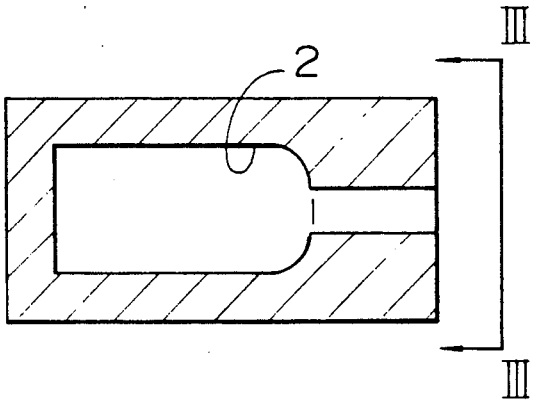
FIG. 2 is a longitudinal section through an article hot worked in accordance with the present invention.
Figure 3:
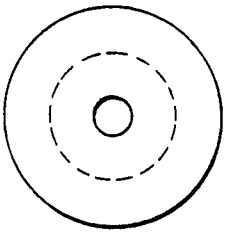
FIG. 3 is a side view taken along the arrows from line III—III in FIG. 2.

Thus, an forged article of FIG. 2 results.

The present embodiment has described the process for working the holed forged article. However, the present invention is applicable to hot workings of other holed articles other than the working of the holed forged article and also simply to heat treatments of holed articles. The use of the process of the present invention prevents an occurrence of a transmuted layer even in a heat treatment conducted in an atmospheric furnace without a need for a vacuum furnace.

Further it will be understood that the present invention is also applicable to a tubular material which has an axially extending through hole and a lid closing the bottom end of the hole.

In accordance with the present invention, since an inert gas, e.g., Ar gas is previously injected into a holed material and then the material is heated and forged with the inert gas completely sealed therewithin, 1) the material can be forged regardless of the heating temperature so that the surface of the hole is protected from a transmutation;

2) an amount of the employed inert gas essentially is as small as the volume of the hole, which is inexpensive; and 3) no special equipment is required so as to provide a inexpensive working.

What is claimed is:

1. A process for hot working an article defining a hole at the center thereof from a tubular material which has a hole being open at one end of the material and closed at the other end of the material, the hot working process comprising the steps of:

injecting an inert gas through said open end into the hole; then fastening a cap to said open end to seal the hole;

heating the tubular material the hole of which has been filled with the inert gas; then hot working the tubular material; then separating said end to which the cap has been fastened from the reminder of the tubular material.

2. A hot working process as recited in claim 1, wherein the cap is fastened by welding to the open end of the tubular material.

3. A hot working process as recited in claim 1, wherein forging constitutes the hot working.

* * * * *